US009297137B2

(12) United States Patent
Herrmann et al.

(10) Patent No.: US 9,297,137 B2
(45) Date of Patent: Mar. 29, 2016

(54) GUIDE FRAME FOR GUIDING A CUTTING APPARATUS

(71) Applicant: BAUER MASCHINEN GmbH, Schrobenhausen (DE)

(72) Inventors: Christian Herrmann, Aichach (DE); Leonhard Weixler, Thierhaupten (DE); Maximilian Arzberger, Igenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 272 days.

(21) Appl. No.: 14/012,959

(22) Filed: Aug. 28, 2013

(65) Prior Publication Data

US 2014/0064857 A1 Mar. 6, 2014

(30) Foreign Application Priority Data

Aug. 30, 2012 (EP) ..... 12006165

(51) Int. Cl.

| | |
|---|---|
| ***E02D 13/08*** | (2006.01) |
| ***E02D 13/04*** | (2006.01) |
| ***E02D 7/00*** | (2006.01) |
| ***E02D 7/28*** | (2006.01) |
| ***E21B 4/18*** | (2006.01) |

(52) U.S. Cl.

CPC .. *E02D 7/00* (2013.01); *E02D 7/28* (2013.01); *E21B 4/18* (2013.01); *E02D 13/04* (2013.01); *E02D 13/08* (2013.01)

(58) Field of Classification Search

CPC ..... E02D 7/28; E02D 13/08; E02D 27/52; E02D 27/525; E02D 13/04

USPC ..... 405/228

See application file for complete search history.

(56) References Cited

U.S. PATENT DOCUMENTS

| | | | | | |
|---|---|---|---|---|---|
| 3,498,675 | A | | 3/1970 | Kampf-Emden et al. | |
| 3,784,257 | A | | 1/1974 | Lauber et al. | |
| 4,742,876 | A | | 5/1988 | Barthelemy et al. | |
| 4,790,886 | A | * | 12/1988 | Daspit | 148/199 |
| 4,856,938 | A | * | 8/1989 | Kuehn | 405/227 |
| 4,904,119 | A | * | 2/1990 | Legendre et al. | 405/228 |

(Continued)

FOREIGN PATENT DOCUMENTS

| | | | |
|---|---|---|---|
| CN | 1381669 | A | 11/2002 |
| CN | 101194072 | A | 6/2008 |

(Continued)

OTHER PUBLICATIONS

The European search report issued on Feb. 21, 2013, which corresponds to EP12006165.0 and is related to U.S Appl. No. 14/012,959.

(Continued)

*Primary Examiner* — Frederick L Lagman

(74) *Attorney, Agent, or Firm* — Studebaker & Brackett PC

(57) ABSTRACT

The invention relates to a guide frame for guiding a cutting apparatus within a pipe incorporated into the ground, having a framework body which can be inserted into the pipe and comprises a guide, along which the cutting apparatus can be displaced, a bracing means for tensioning and fixing the framework body in the pipe, and an adjusting means, with which the cutting apparatus can be adjusted within the pipe in a transverse direction relative to the pipe axis. The invention further relates to a method for anchoring a pipe in the ground.

15 Claims, 8 Drawing Sheets

(56) References Cited

U.S. PATENT DOCUMENTS

| | | | | |
|---|---|---|---|---|
| 5,360,292 | A * | 11/1994 | Allen et al. | 405/249 |
| 2006/0225308 | A1 | 10/2006 | Arzberger et al. | |
| 2009/0129870 | A1 | 5/2009 | Jones | |
| 2012/0076591 | A1 | 3/2012 | Peters | |

FOREIGN PATENT DOCUMENTS

| | | | | | |
|---|---|---|---|---|---|
| DE | 1534611 | A1 | | 8/1969 | |
| DE | 1658736 | A1 | | 11/1970 | |
| DE | 9319684 | U1 | | 4/1995 | |
| DE | 10336315 | A1 | | 3/2005 | |
| DE | 102009023466 | A1 | | 1/2011 | |
| DE | 202010017153 | U1 | | 2/2011 | |
| JP | S62-284818 | A | | 12/1987 | |
| JP | H05-171641 | A | | 7/1993 | |
| JP | H06-81577 | A | | 3/1994 | |
| JP | 06093794 | A | * | 4/1994 | E21D 9/12 |
| JP | 2002-309888 | A | | 10/2002 | |
| KR | 2002-0081071 | A | | 10/2002 | |
| KR | 10-2006-0101252 | A | | 9/2006 | |
| WO | 2010/139380 | A1 | | 12/2010 | |
| WO | WO 2010139380 | A1 | * | 12/2010 | E02D 7/20 |

OTHER PUBLICATIONS

An English translation of Korean Office Action; "Notice of Preliminary Rejection," issued by the Korean Patent Office, which corresponds to Korean Patent Application No. 10-2013-0102808 and is related to U.S. Appl. No. 14/012,959.

* cited by examiner

FIG. 1A
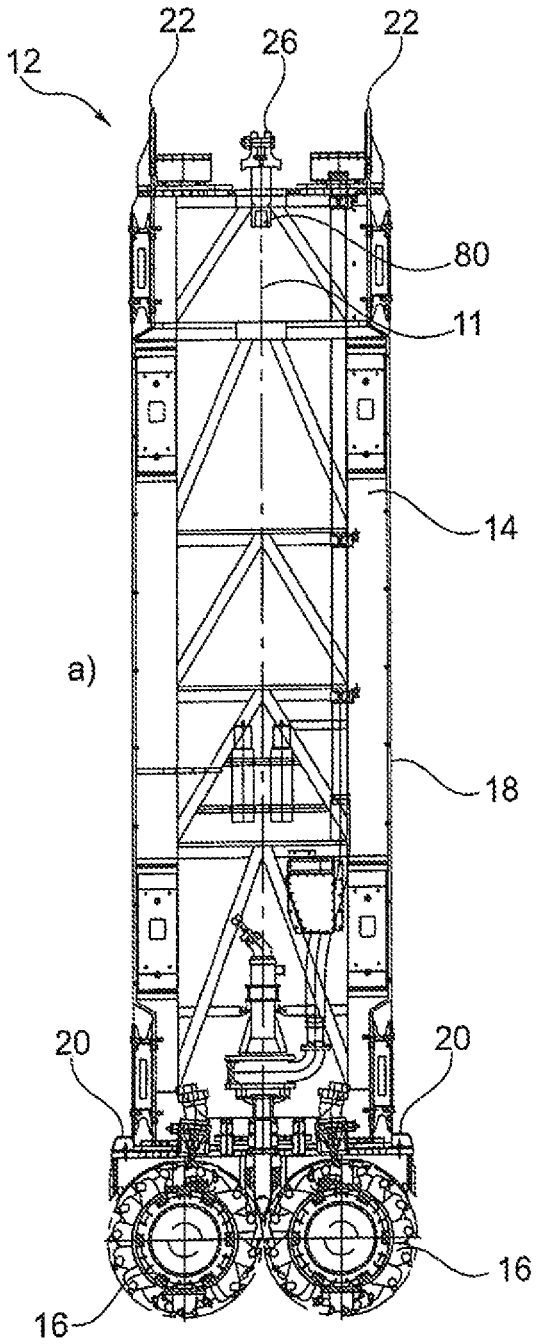
FIG. 1B
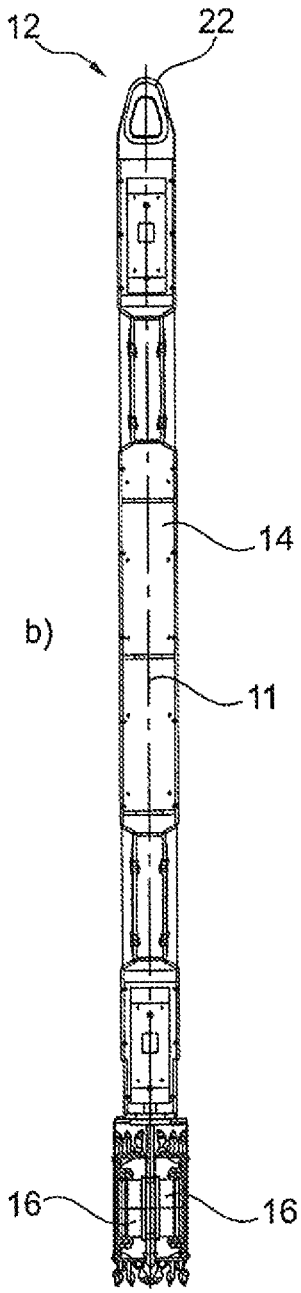
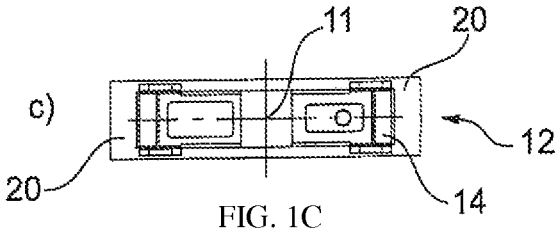
FIG. 1C

FIG. 2A
FIG. 2B
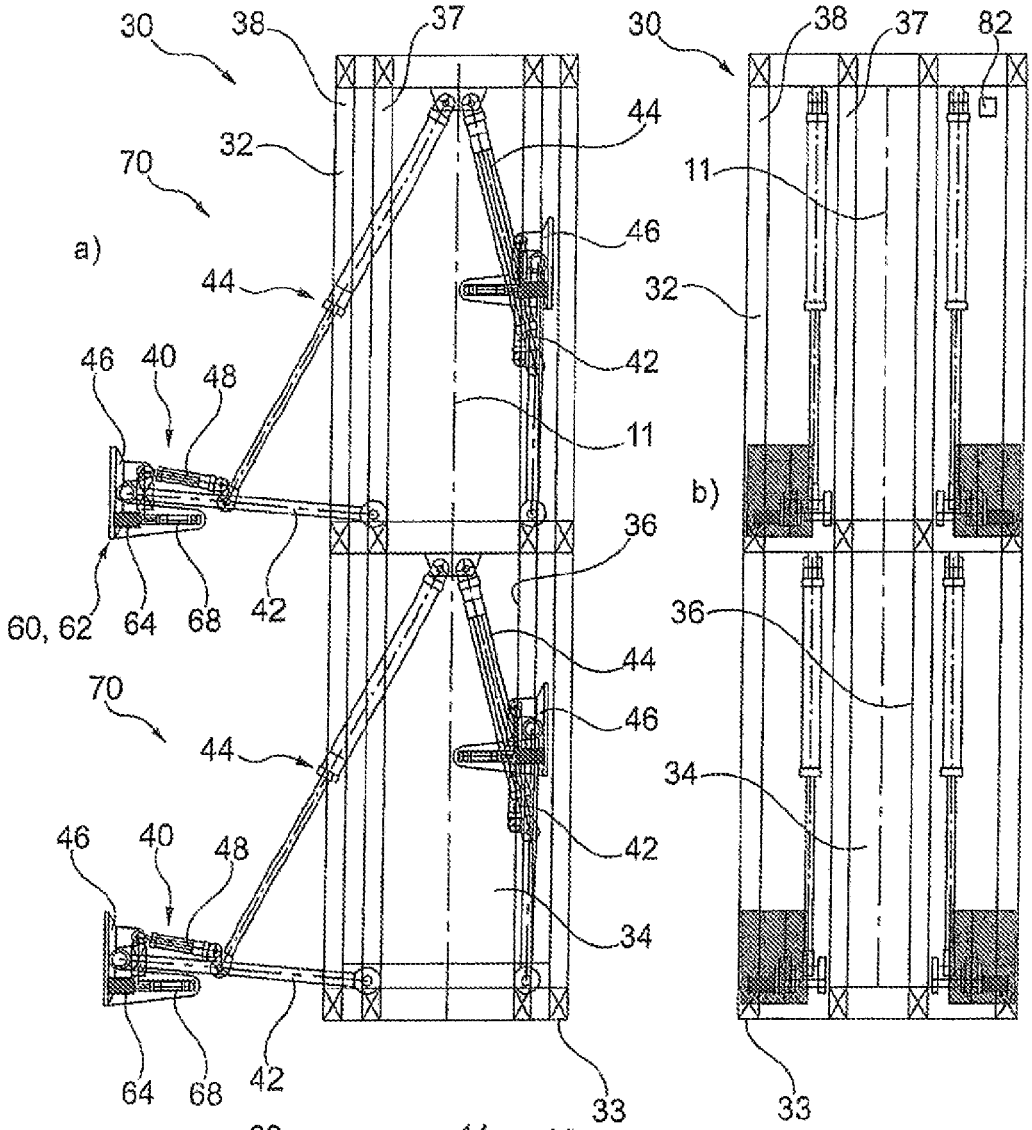
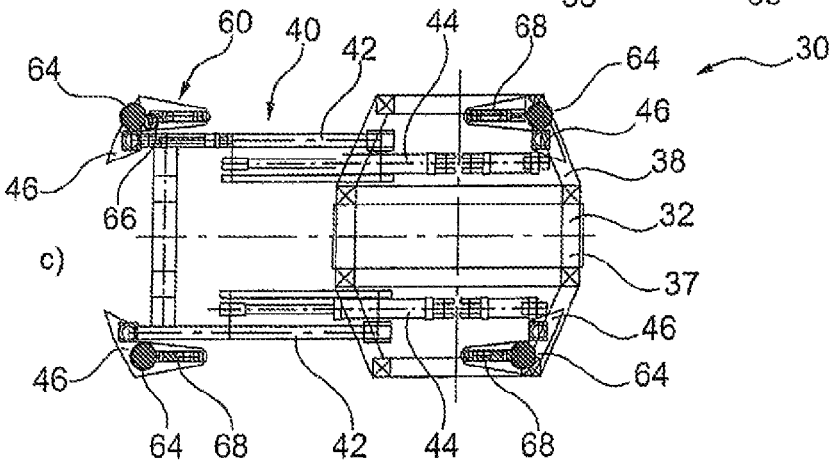
FIG. 2C

FIG. 3A
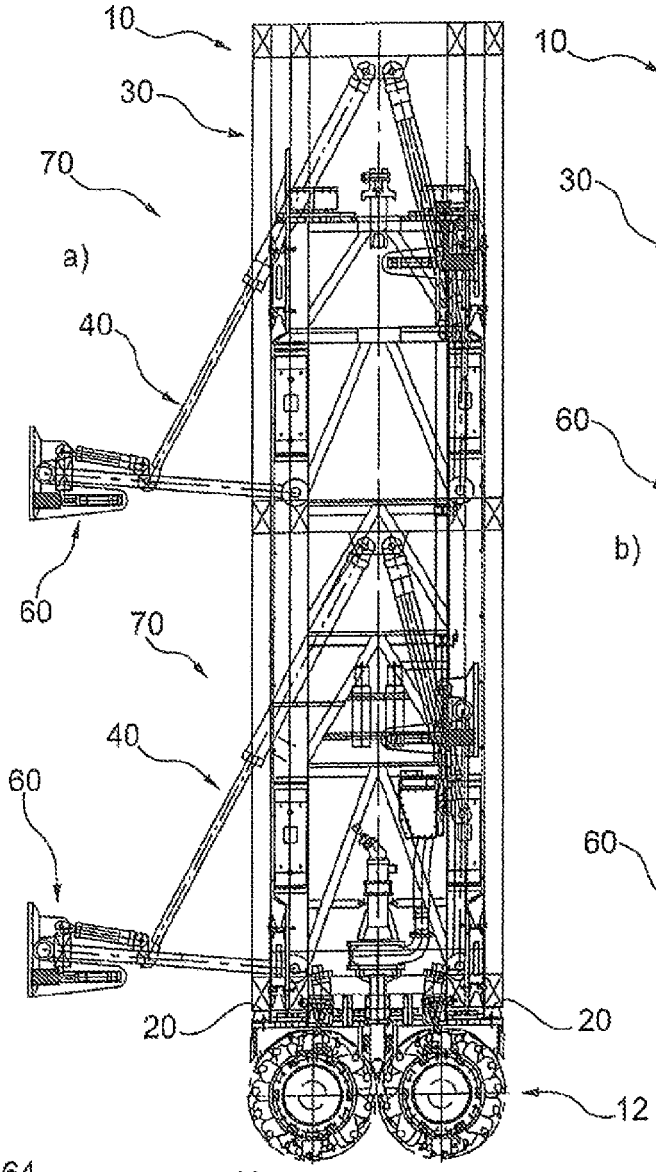
FIG. 3B
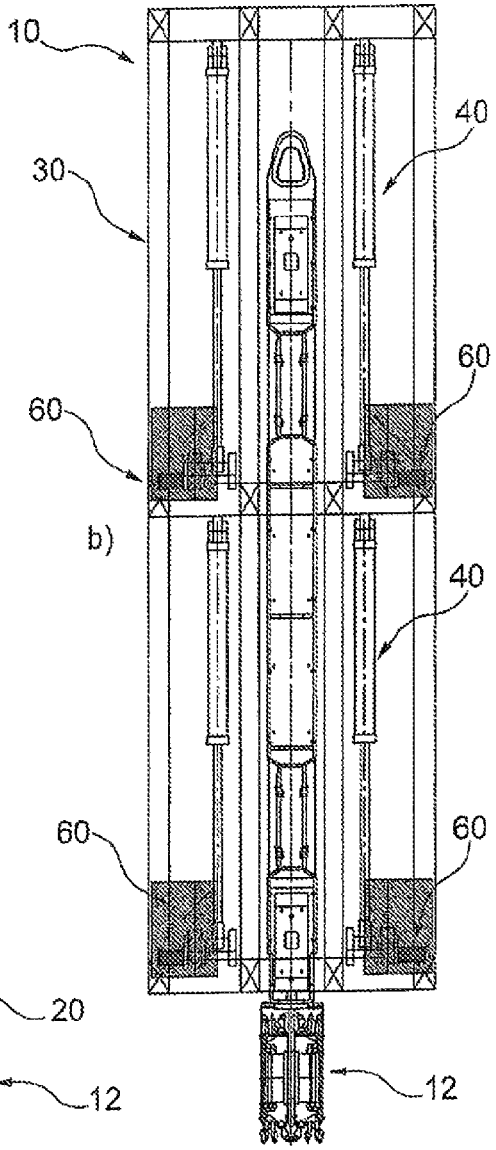
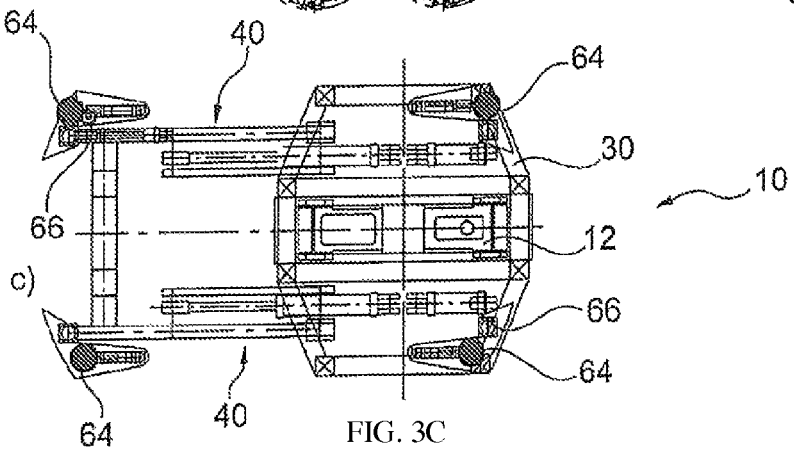
FIG. 3C

FIG. 4A
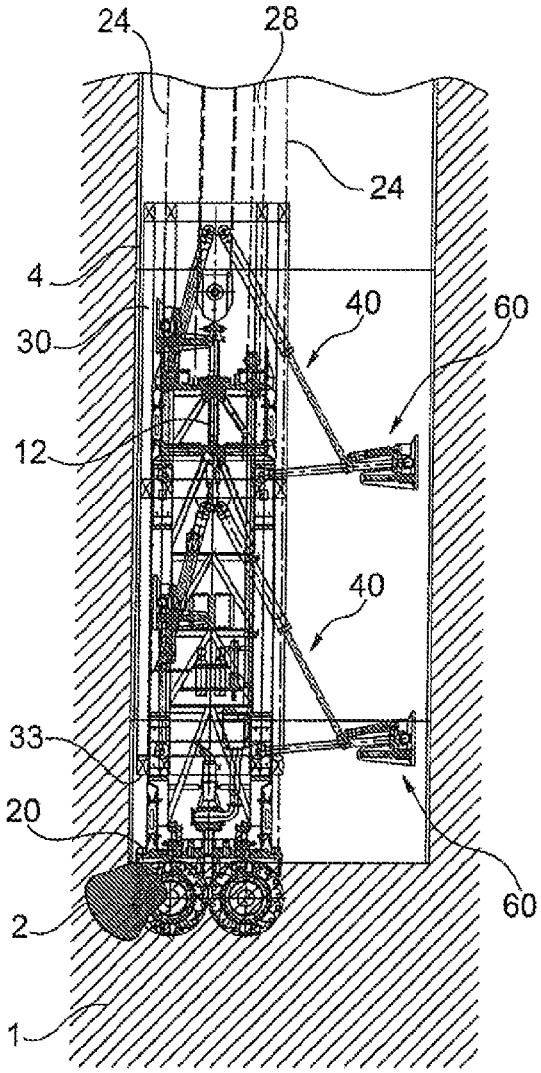
FIG. 4B
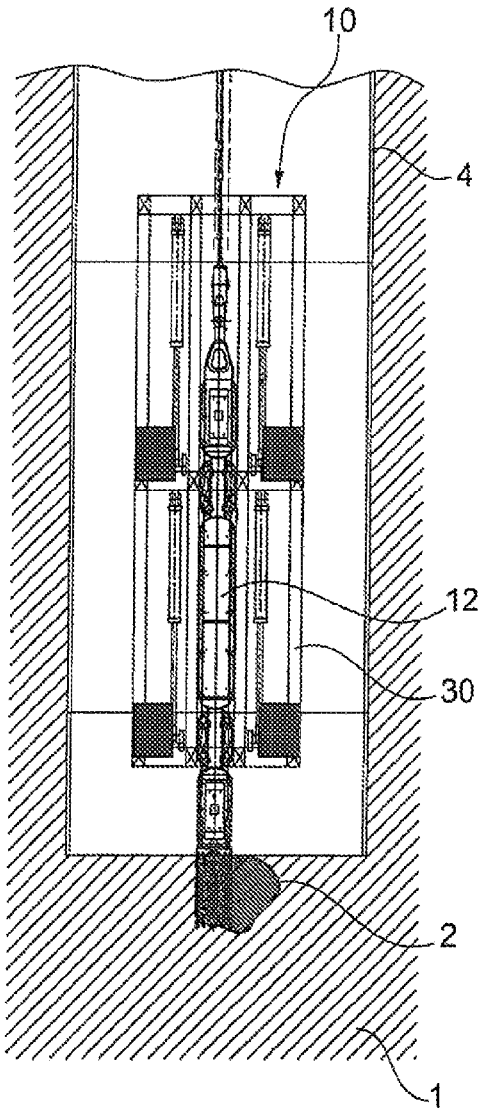
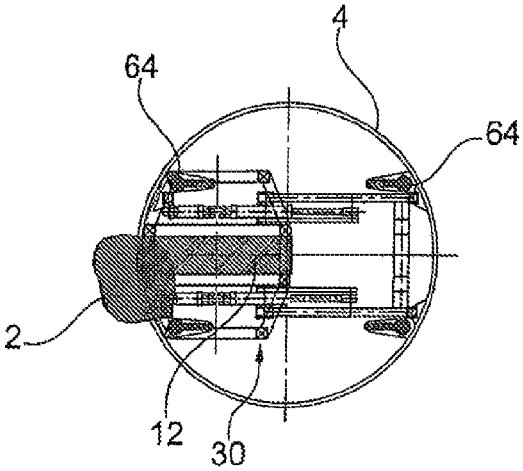
FIG. 4C
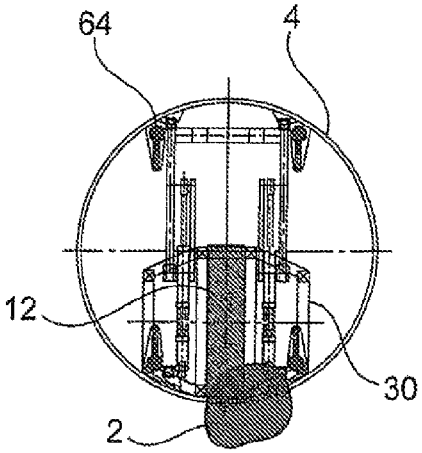
FIG. 4D

GUIDE FRAME FOR GUIDING A CUTTING APPARATUS

The invention relates to a guide frame for guiding a cutting apparatus and to a method for anchoring a pipe in the ground.

When setting up offshore wind power plants, large pile pipes must be anchored as support structures in the seabed. The dimensions of the pile pipes are constantly increasing along with the increasing size of the power plants. Depending upon the application, diameters in the range from five to seven meters can be reached.

The pile pipes are usually driven into the seabed by means of suitable pile driving apparatuses. As the seabed is usually sufficiently soft, driving-in is in principle still possible even with relatively large pipe diameters. It can arise, however, that there are hard stone layers or boulders in the ground which render further driving-in of the pipe considerably more difficult or even make it impossible. Such stone layers or boulders can lead to considerable problems in anchoring, particularly in the case of pipes with a large diameter.

It is thus an object of the invention to indicate an apparatus, by means of which the anchoring of a pipe in the ground can be supported. It is a further object of the invention to indicate an economic method for anchoring a pipe in the ground.

The object is achieved according to the invention through a guide frame having the features of claim 1 and a method having the features of claim 14. Preferred embodiments of the invention are indicated in the respectively dependent claims.

The guide frame according to the invention for guiding a cutting apparatus within a pipe incorporated into the ground comprises a framework body which can be inserted into the pipe and which has a guide, along which the cutting apparatus can be displaced, a bracing means for tensioning and fixing the framework body in the pipe and an adjusting means, with which the cutting apparatus can be adjusted within the pipe in a transverse direction relative to the pipe axis.

The method according to the invention for anchoring a pipe in the ground comprises the following steps: driving the pipe into the ground, inserting a guide frame with a cutting apparatus mounted on it into the pipe and lowering it within the pipe, tensioning the guide frame within the pipe and removing earth within the pipe by driving in a rotating manner at least one cutting wheel of the cutting apparatus and axially lowering the cutting apparatus within the guide frame.

The guide frame according to the invention is used to guide a cutting apparatus axially within a pipe partially incorporated into the ground in order to excavate and/or crush earth material within or below the pipe. According to the invention it is hereby possible to support the incorporation, in particular driving-in, of the pipe into the ground by using the cutting apparatus for example to crush and/or remove hard material below the pipe which hinders further driving-in of the pipe. Such hard material may for example be a boulder projecting below the pipe into the pipe cross-section. After the removal of the hard material or boulder, the pipe can be further incorporated into the ground.

The pipe can be in particular a support mast to be anchored in the ground, for example for a wind power plant, preferably an offshore wind power plant. Such masts can have a diameter of several meters, for example five meters or more. In a usual configuration the mast tapers upwardly, in particular above the water surface, as weaker forces act there.

The cutting apparatus can be in particular a trench wall cutter having horizontally mounted cutting wheels and a substantially square cutting cross-section. Such cutting apparatuses are generally known and are usually used to create milling trenches in the ground.

Such a standard cutter can also be used through the guide frame according to the invention, for the excavation of earth within a pipe incorporated into the ground. An essential aspect in this case is that the cutting apparatus has a smaller cross-section than the inner cross-section of the pipe section incorporated into the ground in order to be able to lift if through the tapered upper section into the pipe.

A first core idea of the invention is that the cutting apparatus is guided axially within the pipe in order to remove earth in a targeted manner in a defined sub-region of the pipe cross-section by means of the cutting apparatus having a smaller diameter and to thereby reliably avoid damage to the pipe. The cutting apparatus is mounted for this purpose so that it can be axially displaced on a framework body of the guide frame in such a way that it can be lowered relative to the framework body during the cutting process. The framework body for its part can be fixedly clamped within the cross-section of the pipe so that reliable guiding is achieved.

A further core idea of the invention is to be able to adjust the cutting apparatus, in particular between individual cutting processes, within the pipe in the transverse direction. The adjusting means provided for this purpose thus moves the cutting apparatus in a pipe cross-sectional plane extending transversely relative to the pipe axis. This is based upon the fact that the cross-section of the cutting apparatus is smaller and usually has a different shape from the inner cross-section of the pipe, in which the cutting apparatus is used. Due to the adjustment possibility of the cutting apparatus within the pipe it is possible to purposefully excavate different sub-regions of the pipe cross-section. Through repeated displacement of the cutting apparatus it is even possible, as an option, to excavate earth in the region of the whole pipe cross-section.

It is preferred according to the invention for the adjusting means to comprise a rotating means, by means of which the cutting apparatus can be rotated within the pipe. For example an inner frame of the guide frame, on which the cutting apparatus is mounted, can be rotated relative to an outer frame tensioned in the pipe. It is particularly preferable on the other hand for the whole guide frame which is tensioned or can be tensioned in the pipe to be rotatable in the pipe.

The adjusting means preferably comprises a displacement means, by means of which the cutting apparatus can be displaced transversely relative to the pipe axis. This can be provided for example in that the framework body can be tensioned in the pipe by means of extendible bracing or spreading arms wherein the bracing arms facilitate different radial positioning of the cutting frame within the pipe cross-section. In particular, opposing bracing arms can be provided which can optionally be extended to different distances, thus non-symmetrically to each other.

According to a preferred embodiment at least one roller is provided which lies against a pipe inner wall of the pipe and rolls on it in order to rotate the framework body with the cutting apparatus around the pipe axis. It is possible in this case in a particularly advantageous way for the whole guide frame with the cutting apparatus arranged thereon to rotate within the pipe. It is particularly preferable for the at least one roller to be designed as a support roller which is supported on the pipe inner wall and thus supports the guide frame. The support roller can thereby preferably be held by friction locking on the pipe inner wall. Furthermore it is preferable for the support roller to be pressable against the pipe inner wall and thus to form part of the bracing means, with which the guide frame can be tensioned in the pipe. In this way the guide frame can rotate in the pipe during the clamped-in state. It is particularly preferable for a plurality of rollers to be provided.

At least one rotary drive is preferably provided, with which the at least one roller can be driven to produce a rotation movement of the framework body. It is possible in this way to achieve, in a particularly simple manner, a rotation of the apparatus which is clamped in or freely suspended on a support cable.

According to a preferred embodiment of the invention the at least one roller can be radially extended relative to the framework body to contact the pipe inner wall. The radially extendible roller facilitates on the one hand tensioning of the framework body within the pipe and on the other hand an adaptation to different pipe cross-sections.

The bracing means preferably comprises at least one bracing element which can be radially extended relative to the framework body. In order to extend the bracing element, for example a bracing or clamping jaw, a hydraulic cylinder may be provided. The bracing element can also be formed by the support roller so that a rotation of the guide frame is possible in the clamped-in state.

It is preferable for the framework body to have a stop, by means of which the guide frame can be supported on the cutting apparatus. The guide frame can thus be placed on the cutting apparatus and be supported or carried by it. A cable suspension is preferably provided on the cutting apparatus, with which the cutting apparatus can be suspended on a carrier apparatus. This makes it unnecessary to provide a separate lifting means to respectively lower or raise the guide frame. Instead, the guide frame can be held via the cutting apparatus and be inserted into the pipe or moved out of it.

It is further preferable for the cutting apparatus to be able to be arranged and guided obliquely within the pipe in order to undercut a region below a pipe wall of the pipe. It is particularly preferable in this case for the whole guide frame to be able to be arranged obliquely within the pipe, thus transversely relative to a longitudinal axis of the pipe. If the guide frame is arranged in a lower region of the pipe, a region below the pipe wall can be cut away by the obliquely guidable cutting apparatus in order for example to crush or remove hard stone such as a boulder located there. The guide frame comprises preferably differently extendible bracing arms for the oblique arrangement of the cutting apparatus.

It is also preferred for at least one roller to be provided which rolls, upon rotation of the framework body around the pipe axis, on a pipe inner wall of the pipe and for the at least one roller to be mounted in a radially extendible manner on a bracing element which can be radially extended relative to the framework body. In this case it is possible, optionally, to set a fixed tensioning or a tensioning, with which the guide frame can be rotated within the pipe. On the one hand the framework body can be fixedly tensioned within the pipe by means of the radially extendible bracing element, for example a clamping jaw. On the other hand, instead of the bracing element, the roller, in particular the support roller, can be used to tension the guide frame. For this purpose the roller mounted on the bracing element can be radially extended relative to the bracing element so that it projects radially over the abutment surface of the bracing element.

In order to supply the adjusting means and/or bracing means with a hydraulic fluid, a hydraulic connection can be provided on the guide frame and be coupled to a hydraulic connection of the cutting apparatus. The guide frame can thus be supplied with hydraulic fluid via the cutting apparatus which is connected to a hydraulic unit. A separate hydraulic supply of the guide frame is not then necessary.

The invention relates furthermore to an apparatus for removing earth within a pipe which is at least partially incorporated or driven into the ground. The apparatus comprises a guide frame according to the invention and a cutting apparatus which is mounted on the guide frame and comprises a cutting frame and at least one cutting wheel mounted on the cutting frame. The unit comprising the cutting apparatus and guide frame is provided in particular to excavate earth within a pile, in particular a support mast or pile pipe to be anchored in the ground. The cutting apparatus can be in particular a standard cutter, for example a trench wall cutter. The guide frame is adapted to be placed on such a standard cutter and held by it.

A cable suspension is preferably provided on the cutting apparatus. This allows the cutting apparatus to be suspended on a carrier unit via a support cable.

Having regard to the method according to the invention it is preferable for the following further steps to be provided: adjusting the cutting apparatus in a transverse direction relative to the pipe axis within the pipe, in particular rotating and/or displacing the cutting apparatus within the pipe, and removing earth along a different cutting cross-section within the pipe by driving in a rotating manner the at least one cutting wheel of the cutting apparatus and axially lowering the cutting apparatus within the guide frame. Through, in particular, repeated adjustment of the cutting apparatus within the pipe cross-section, it is possible, by means of the smaller-diameter cutting apparatus, to excavate virtually the whole cross-section of the pipe. It is particularly preferred in this case for the cutting apparatus to be eccentrically arranged within the pipe cross-section and to be gradually rotated within the pipe cross-section until the whole pipe cross-section is excavated.

Insofar as required, the cutting apparatus can be clamped obliquely within the pipe cross-section, thus inclined relative to the pipe axis, and can remove earth below the pipe wall. An obstacle below the pipe wall can thus be removed particularly simply.

The invention will be described in more detail below by reference to preferred embodiments shown in the attached schematic drawings, in which:

FIGS. 1A-1C show a cutting apparatus in different views;

FIGS. 2A-2C show a guide frame according to the invention in different views;

FIGS. 3A-3C show a guide frame according to the invention in different views with a cutting apparatus inserted therein;

FIGS. 4A-4D show an apparatus inserted into a pipe for removing earth with a guide frame and cutting apparatus in different views;

Figure 9:
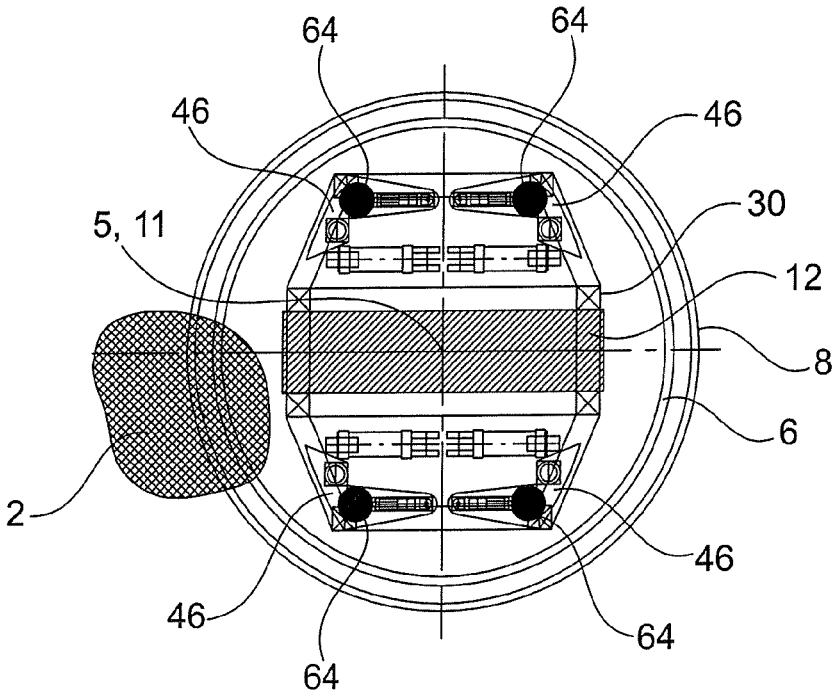

FIG. 9: shows a top view of a pipe to be anchored in the ground with an apparatus inserted therein to remove earth.

The same or similarly working components are identified in all the figures by the same reference symbols.

FIG. 1 shows a cutting apparatus 12 for removing earth which can also be described in particular as a trench wall cutter and constitutes a standard cutter. FIG. 1*a*) thereby shows the cutting apparatus 12 in a first side view, FIG. 1*b*) shows the cutting apparatus 12 in a second side view and FIG. 1*c*) shows a top view of the cutting apparatus 12.

The cutting apparatus 12 comprises a cutting frame 14, at the lower end of which a plurality of cutting wheels 16 are mounted in pairs so as to be rotatable around respectively horizontal rotation axes. The cutting frame 14 comprises lateral guide faces 18 which extend along a vertical longitudinal axis 11. The cutting frame 14 further comprises a stop 20, on which a guide frame 30 according to the invention, as described below, can be placed. The cutting apparatus 12 has a substantially square cross-section.

Figure 6:
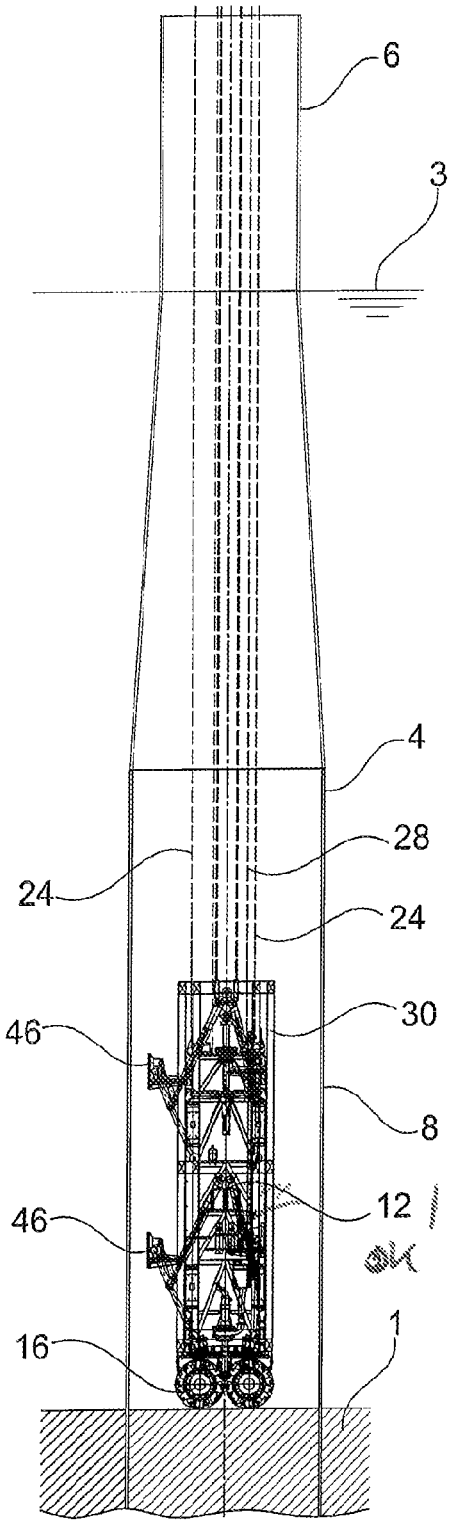
FIG. 6 shows a first step of a method according to the invention.
Figure 7:
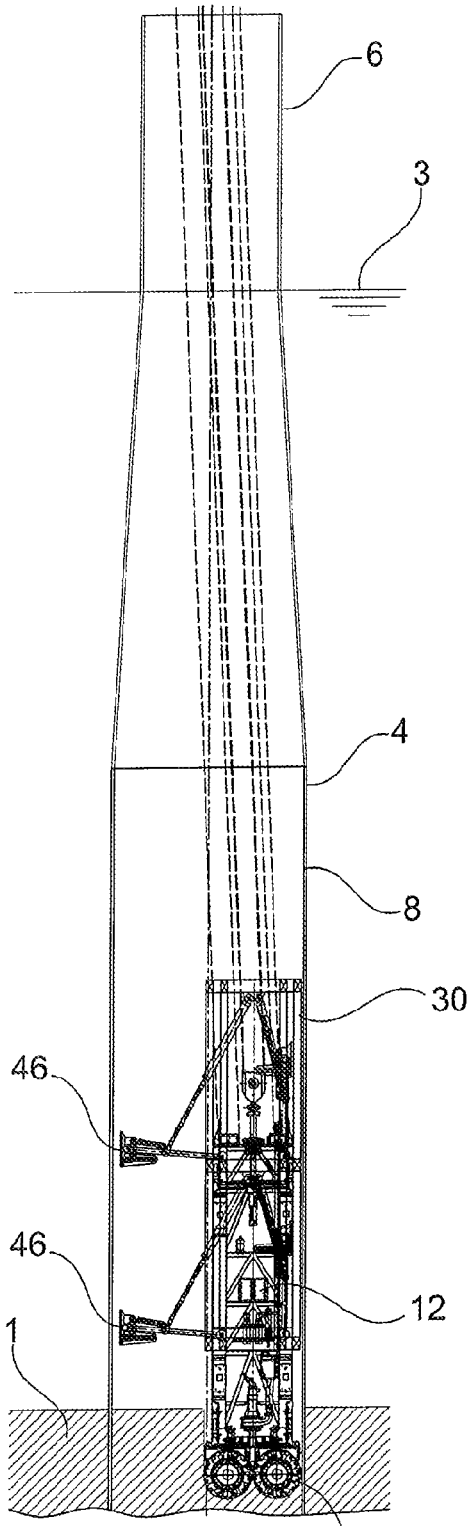
FIG. 7 shows a second step of a method according to the invention.
Figure 8:
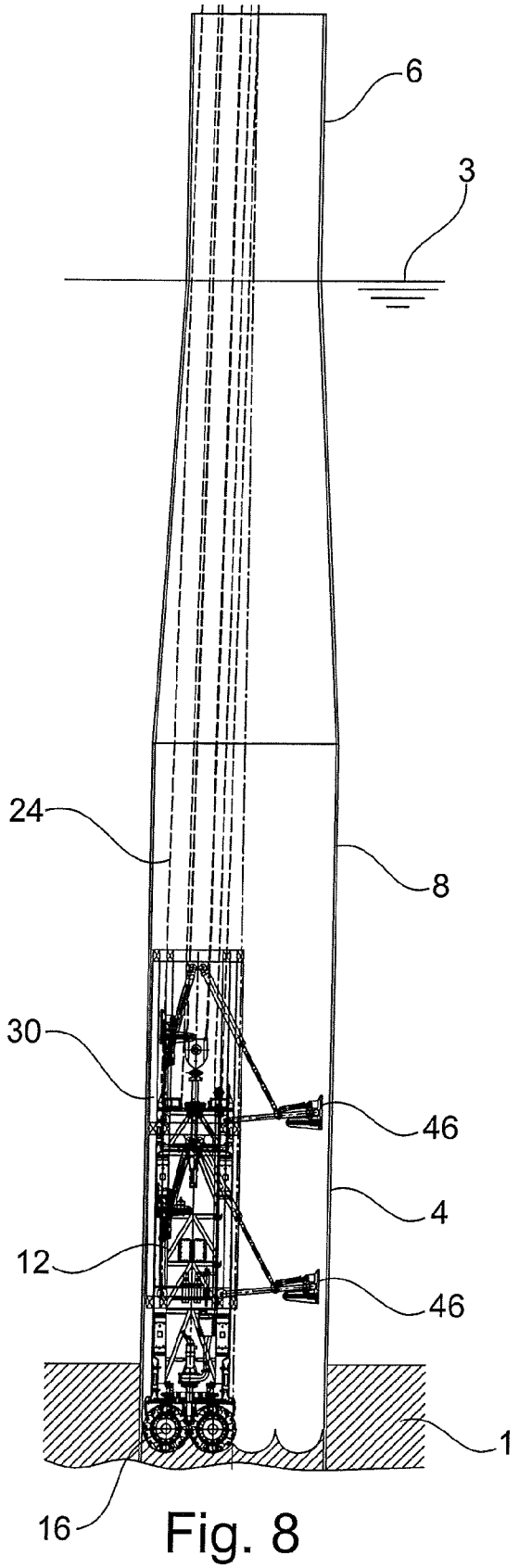
FIG. 8 shows a third step of a method according to the invention.

A cable suspension 22 is provided at an upper end of the cutting frame 14, by means of which the cutting apparatus 12 can be suspended on support cables 24 (FIGS. 6 to 8). In order to supply the cutting apparatus 12 with hydraulic fluid, a hydraulic connection 26 is further provided, to which hydraulic lines 28 can be connected (FIGS. 6 to 8). The support cables 24 and the hydraulic lines 28 extend vertically from the cutting apparatus 12 upwards to a carrier unit (not shown), on which the cutting apparatus 12 is suspended.

FIGS. 2*a*) to 2*c*) show a guide frame 30 according to the invention in views corresponding to FIG. 1. The guide frame 30 has a framework body 32, in which a receiving space 34 for receiving a cutting apparatus 12, as shown in FIG. 1, is formed. The framework body 32 comprises an inner frame 37 with a square cross-section and a guide 36 for receiving and guiding the cutting apparatus 12 and two outer frames 38 arranged on opposing sides of the inner frame 37 with respectively trapezoidal cross-sections. The outer frames receive a bracing means 40 for tensioning the framework body 32 and an adjusting means 60 for adjusting the framework body 32 within a pipe 4.

A pivot lever 42 is pivotably mounted on the framework body 32 as part of the bracing means 40 and can be pivoted between a withdrawn position within the cross-section of the framework body 32 and a laterally extended position. There is a bracing element 46—which can also be called a clamping jaw or clamping shoe—arranged at an outer end of the pivot lever 42 or bracing arm, for placing against an inner wall of a pipe 4 (FIGS. 4 to 8) for tensioning the guide frame 30 in the pipe 4. The clamping or bracing element 46 comprises a curved clamping or tensioning surface for placing against the curved inner wall of the pipe 4.

In order to pivot the pivot lever 42 a tensioning cylinder 44, in particular a hydraulic cylinder, is provided, which is connected on the one hand to the framework body 32 and on the other hand to the pivot lever 42. The connection point to the pivot lever 42 is located approximately centrally between the bracing element 46 and the rotation axis of the pivot lever 42. The connection point on the framework body 32 is arranged above the rotation point of the pivot lever 42.

As can be deduced from FIG. 2, the bracing means 40 comprises opposing, in particular identically formed, bracing units or pivot lever arrangements for tensioning the guide frame in the pipe 4. The bracing units can be actuated varyingly and/or independently in order to tension the guide frame 30 eccentrically in the pipe 4. In this connection, in particular, one of the bracing elements 46 can be moved out further relative to the cross-section of the framework body 32 than the other one.

At least two pairs of bracing units, each with a pivot lever 42, tensioning cylinder 44 and bracing element 46, are arranged axially offset along the longitudinal axis 11 for secure tensioning within the pipe 4. Each bracing unit can be independently actuated so that the guide frame 30 can also be clamped, through corresponding positions of the bracing units, obliquely relative to the pipe axis 5 in the pipe. The guide frame 30 thus comprises a pivot means for oblique positioning of the guide frame 30 within the pipe 4. In order to pivot the guide frame 30 within the pipe 4, the bracing elements 46 are extended to a different distance at different heights of the guide frame 30. This allows guiding of the cutting apparatus 12 obliquely relative to the pipe axis 5 so that a region can also be machined below the pipe wall, for example in order to remove a boulder there.

The bracing elements 46 are mounted on the pivot lever 42 so that they can be pivoted about a horizontal axis. In order to pivot the bracing elements 46 relative to the pivot lever 42, a pivot means 48, in particular a pivot cylinder, is provided. The pivoting of the bracing elements 46 is used in particular to adapt the orientation thereof to the respective position of the pivot lever 42.

The differently actuated bracing units can also be regarded as part of a displacement means 70, with which the guide frame 30 can be moved in a transverse direction relative to the pipe axis 5 within the pipe 4. The transverse displacement of the guide frame 30 can take place in particular through varying actuation of opposing tensioning cylinders 44.

The guide frame 30 comprises, as part of the adjusting means 60, a rotating means 62 with rollers 64 for lying against an inner wall of the pipe 4. At least one of the rollers 64 can be driven in a rotating manner by means of a rotary drive 66 in order to rotate the guide frame 30 within the pipe 4 along the pipe inner wall. Two of the four rollers are preferably designed as driven rollers.

The rollers 64 are mounted to be radially adjustable on the framework body 32 so that they can be adjusted between a withdrawn position, in which they are withdrawn from the pipe inner wall, and an abutment position, in which they lie against the pipe inner wall. In order to move the rollers in or out, an adjusting means 68, in particular a hydraulic cylinder, is provided.

In the embodiment shown, the rollers 64 are mounted on the bracing elements 46. By means of the adjusting means 68 the rollers 64 can be radially moved relative to the bracing elements 46 between a position, in which they project outwards relative to the abutment surface of the bracing elements 46, and a position, in which they are withdrawn relative to the abutment surface. The rollers 64 are designed in particular as support rollers and can hold the guide frame 30 by means of friction locking connection in the pipe 4. The rollers 64 can thus be regarded as part of the bracing means 10, wherein they serve as bracing elements for abutment against the pipe inner wall. The guide frame 30 can thus be tensioned by radially moving out the rollers 64 in the pipe 4 and be rotated in the pipe, so to speak, in the tensioned state.

The guide frame 30 is attached via a hydraulic connection 82 to a corresponding hydraulic connection 80 of the cutting apparatus 12. FIG. 3 shows, in views corresponding to those of FIGS. 1 and 2, a guide frame 30 with a cutting means 12 inserted therein. The guide frame 30 is placed from above on the cutting apparatus 12 and lies on the cutting frame 14. In this connection a stop 33 is provided with a downwardly orientated stop surface, by means of which the guide frame lies on the stop 20 of the cutting frame 14. The cutting apparatus 12 thus carries the guide frame 30. The cutting wheels 16 of the cutting apparatus 12 project in this case downwardly outwards relative to the guide frame 30.

FIG. 4 shows in different views an apparatus 10 inserted into a pipe 4 for removing earth, said apparatus comprising a cutting apparatus 12 with a guide frame 30 mounted thereon. The cutting apparatus 12 is held by means of support cables 24 by a carrier unit which can be located for example on a platform or a ship at the water surface 3. The guide frame 30 lies, upon lowering the apparatus 10, on the stop 20 of the cutting apparatus 12 and is held by means thereof.

The cutting apparatus 12 has a smaller cross-section than the pipe 4. In order to remove earth material within the pipe 4, the guide frame 30 is tensioned in the pipe 4 by means of the bracing means 40. As can be deduced from the left illustrations of FIG. 4, the framework body 32 can be eccentrically clamped with the guide 36, thus in a side region of the pipe 4, so that the cutting apparatus 12 is guided eccentrically in the pipe 4. When the guide frame 30 is tensioned the cutting apparatus 12 can be moved downwards relative to the guide frame 30 to remove earth material, as shown in the upper illustrations of FIG. 4.

Figure 5:
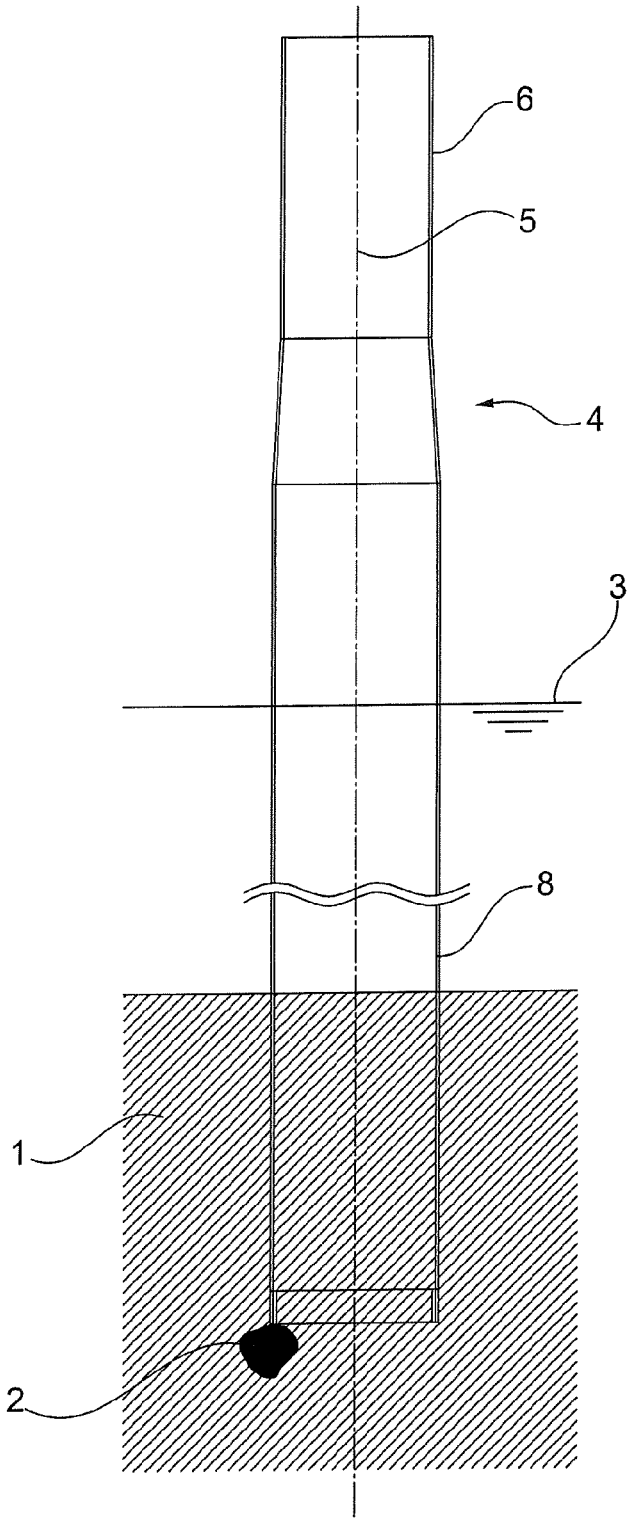
FIG. 5 shows the initial situation in a method according to the invention.

The method according to the invention for incorporating a pipe into the ground will be described by the example of the anchoring of a foundation pipe or pile pipe for an offshore wind power plant with reference to FIGS. 5 to 8:

The pipe 4 of the offshore wind power plant is driven by means of a top driving hammer into the ground 1 or the seabed until it meets, as the case may be, a boulder 2, as schematically indicated in FIG. 5. The pipe 4 comprises a lower section 8 having a greater diameter and an upper section 6 having a smaller diameter. A water surface is identified by the reference numeral 3.

In order to eliminate the boulder 2, the apparatus 10 according to the invention—which can also be described as a boulder cutter—which fits into the upper tapered opening of the pile pipe is used.

The cutting apparatus 12 is inserted from above into the pipe 4 and lowered by means of a support cable 24 as far as the ground surface or the seabed. The cutting apparatus is then tensioned in the pile pipe (FIG. 6) by means of the guide frame 30 which can also be described as a clamping and adjusting frame and lies on the cutting apparatus 12.

By driving the cutting wheels 16 in a rotating manner, earth is removed, whereby the cutting apparatus 12 moves downwards relative to the guide frame 30, in particular due to its own weight (FIG. 7).

The pile pipe is bored out in sections and by displacing the cutting apparatus 12 by means of the guide frame 30. In this connection the cutting apparatus 12 can be laterally displaced and/or be pivoted by a certain amount, for example 90°. In this connection the fixed tensioning of the guide frame 30 is released, the guide frame 30 is raised, displaced and/or rotated and fixed again by means of the bracing elements 46.

Earth can now be removed along a different cross-sectional region (FIG. 8).

Upon reaching the pile end, the boulder 2 is cut away and the cutting apparatus 12 can undercut the inner pile wall, in particular due to its oblique positioning, in order to improve the further penetration of the pile.

FIG. 9 shows a top view of a pipe 4 with an apparatus 10 inserted therein to remove earth. As can be deduced from the figure, the bracing means 40 is completely moved in to tension the guide frame 30 and is located within the cross-section of the framework body 32. The cross-section of the framework body 32 when the bracing means is moved in has such dimensions that it fits into the tapered section 6 of the pipe 4.

All in all, the apparatus 10 according to the invention and the corresponding method allow a tubular body to be driven into the ground, in particular into a riverbed or seabed, in a considerably simplified manner. A particularly economical creation of support structures in the ground, in particular in the seabed, is thus possible.

The invention claimed is:

1. Guide frame for guiding a cutting apparatus within a pipe incorporated into the ground, comprising:

a framework body which can be inserted into the pipe and comprises a guide, along which the cutting apparatus can be displaced, a bracing means for tensioning and fixing the framework body in the pipe, and an adjusting means, with which the cutting apparatus can be adjusted within the pipe in a transverse direction relative to the pipe axis, wherein a diameter of the pipe is larger than a diameter of the framework body, the framework body comprises a receiving space for receiving the cutting apparatus and a first stop, by means of which the guide frame can be supported and carried on the cutting apparatus, whereby the first stop is arranged on a bottom end of the framework body, and the cutting apparatus comprises a second stop, on which the first stop of the framework body lies.

2. Guide frame according to claim 1, wherein the adjusting means comprises a rotating means, by means of which the cutting apparatus can be rotated within the pipe.

3. Guide frame according to claim 1, wherein the adjusting means comprises a displacement means, by means of which the cutting apparatus can be displaced transversely relative to the pipe axis.

4. Guide frame according to claim 1, wherein at least one roller is provided which lies against a pipe inner wall of the pipe and rolls on the pipe inner wall in order to rotate the framework body with the cutting apparatus around the pipe axis.

5. Guide frame according to claim 4, wherein at least one rotary drive is provided, with which the at least one roller can be driven to produce a rotation movement of the framework body.

6. Guide frame according to claim 4, wherein the at least one roller can be radially extended relative to the framework body in order to contact the pipe inner wall.

7. Guide frame according to claim 1, wherein the bracing means comprises at least one bracing element which can be radially extended relative to the framework body.

8. Guide frame according to claim 1, wherein the cutting apparatus can be arranged and guided obliquely within the pipe in order to undercut a region below a pipe wall of the pipe.

9. Guide frame according to claim 1, wherein at least one roller is provided which rolls on a pipe inner wall of the pipe upon rotation of the framework body around the pipe axis, and the at least one roller is mounted so that the at least one roller can be radially extended on a bracing element which can be radially extended relative to the framework body.

10. Guide frame according to claim 1, wherein in order to supply the adjusting means and/or the bracing means with a hydraulic fluid, a hydraulic connection is provided on the guide frame which can be coupled to a hydraulic connection of the cutting apparatus.

11. Method for anchoring a pipe in the ground, comprising the following steps:

driving the pipe into the ground, inserting a guide frame with a cutting apparatus mounted thereon into the pipe and lowering the guide frame within the pipe, tensioning the guide frame within the pipe, and removing earth within the pipe by driving in a rotating manner at least one cutting wheel of the cutting apparatus and axially lowering the cutting apparatus within the guide frame, wherein the guide frame comprises a framework body, a diameter of the pipe is larger than a diameter of the framework body, the framework body comprises a receiving space for receiving the cutting apparatus and a first stop, by means of which the guide frame can be supported and carried on the cutting apparatus, whereby the first stop is arranged on a bottom end of the framework body, and the cutting apparatus comprises a second stop, on which the first stop of the guide frame lies.

12. Method according to claim 11, wherein the following further steps are provided:

adjusting the cutting apparatus in a transverse direction to the pipe axis within the pipe, in particular rotating and/or displacing the cutting apparatus within the pipe, and removing earth along a different cutting cross-section within the pipe by driving in a rotating manner the at least one cutting wheel of the cutting apparatus and axially lowering the cutting apparatus within the guide frame.

13. Apparatus for removing earth within a pipe at least partially incorporated into the ground, comprising:

a cutting apparatus; and a guide frame for guiding the cutting apparatus within the pipe incorporated into the ground, comprising:

a framework body which can be inserted into the pipe and comprises a guide, along which the cutting apparatus can be displaced, a bracing means for tensioning and fixing the framework body in the pipe, and an adjusting means, with which the cutting apparatus can be adjusted within the pipe in a transverse direction relative to the pipe axis, wherein a diameter of the pipe is larger than a diameter of the framework body, the framework body comprises a receiving space for receiving the cutting apparatus and a first stop, by means of which the guide frame can be supported and carried on the cutting apparatus, whereby the first stop is arranged on a bottom end of the framework body, and the cutting apparatus comprises a second stop, on which the first stop of the framework body lies.

14. Apparatus according to claim 13, wherein the cutting apparatus is mounted on the guide frame and comprises a cutting frame and at least one cutting wheel which is rotatably mounted on the cutting frame.

15. Apparatus according to claim 13, wherein a cable suspension is provided on the cutting apparatus.

* * * * *